US005985107A

United States Patent [19]

McLaughlin

[11] Patent Number: 5,985,107

[45] Date of Patent: Nov. 16, 1999

[54] PORTABLE SELF-POWERED HAND-HELD ELECTROPLATING WAND

[75] Inventor: Daniel A. McLaughlin, Madeira Beach, Fla.

[73] Assignee: Gold Effects, Inc., Largo, Fla.

[21] Appl. No.: 09/002,044

[22] Filed: Dec. 31, 1997

[51] Int. Cl.[6] ..... C25D 17/14

[52] U.S. Cl. ..... 204/224 R; 204/271

[58] Field of Search ..... 204/224 R, 271

[56] References Cited

U.S. PATENT DOCUMENTS

| | | | |
|---|---|---|---|
| 1,319,192 | 10/1919 | Von Madaler et al. | 204/224 R |
| 3,346,477 | 10/1967 | Wolfer | 204/224 R |
| 3,520,792 | 7/1970 | Kerschgens | 204/271 X |
| 3,525,681 | 8/1970 | Rapids . | |
| 3,746,627 | 7/1973 | Rapids . | |
| 3,755,089 | 8/1973 | Rapids . | |
| 4,176,036 | 11/1979 | Rapids . | |
| 4,431,501 | 2/1984 | Leppanen . | |
| 4,495,045 | 1/1985 | Jackson | 204/271 X |
| 4,992,154 | 2/1991 | Ida et al. | 204/271 X |
| 5,401,369 | 3/1995 | Gershin . | |
| 5,482,605 | 1/1996 | Taylor . | |

FOREIGN PATENT DOCUMENTS

| | | | |
|---|---|---|---|
| 102392 | 11/1937 | Australia | 204/224 R |
| 469437 | 7/1937 | United Kingdom | 204/224 R |

*Primary Examiner*—Donald R. Valentine
*Attorney, Agent, or Firm*—Larson & Larson, P.A.; James E. Larson

[57] ABSTRACT

An electroplating wand has a tubular housing with a battery compartment at a first end and an elongated anode protruding from a second end of the housing. The anode is covered with a cloth material that absorbs plating solution when immersed within a container of plating solution. A DC battery is received within the battery chamber and provides the sole power source for the wand. A cap for a container of plating solution is clamped on the anode with the end of the anode protruding past the cap so that it can be immersed within a container of plating solution while the container is fastened to the cap over the end of the anode. A ground wire protrudes from the battery chamber and has a clip allowing it to be fastened to the material that is to be plated.

19 Claims, 3 Drawing Sheets

PORTABLE SELF-POWERED HAND-HELD ELECTROPLATING WAND

BACKGROUND OF THE INVENTION

The present invention relates to a portable electroplating wand. More specifically, it refers to a hand-held, battery operated electroplating wand that has an anode located within a container for protection during non-use and for obtaining a source of plating solution during use.

It is known to use a wand including an anode to electroplate metallic materials. In such devices known to Applicant, an electrical conductor is used to connect the electrical circuitry of the wand to a source of electrical power. This source of electrical power can be a separate storage battery such as, for example, a car battery or a source of AC power provided via a transformer. Applicant is unaware of any plating device that is completely portable and self-contained, requiring no outside connection to a power source or separate plating solution bath.

The prior art known to Applicant describes electroplating devices such as in U.S. Pat. No. 5,482,605 where the portable device cannot be hand held, and U.S. Pat. Nos. 3,525,681; 3,746,627; 3,755,089; 4,176,036; 4,431,501 and 5,401,369 where an outside source of power is required for a portable electroplating device.

A portable hand-held electroplating device is needed with a self-contained power source and plating solution so that one can easily and inexpensively plate areas where previous plating has rubbed off or chipped off. This is particularly a problem for gold touch-up plating where the soft nature of gold and rubbing causes wear over metal-coated gold surfaces. A portable hand-held electroplating device that can be easily stored for later use would serve the purpose of touch-up plating.

The present invention solves this problem and differs from the teachings of the prior art references as contemplating an electroplating wand that is completely self-powered and hand-held, requiring no outside connection to a power source and, further, as including a cap from a plating solution container clamped to the anode.

SUMMARY OF THE INVENTION

The present invention relates to a portable self-powered, hand-held electroplating wand with means for direct supply of plating solution. The present invention includes the following interrelated objects, aspects and features:

(1) In a first aspect, the inventive wand includes an elongated tubular housing of a size adapted for use in the palm of a person's hand, the housing having an outer covering of an insulative material such as rubber. The housing has a first open end allowing access to a battery chamber and a second closed end.

(2) A battery is received within the battery chamber and may, if desired, comprise a typical rectangular cubic 9 volt DC battery such as is commonly used in powering portable radios.

(3) The closed end of the housing has, protruding therethrough, an elongated anode. The anode portion outside the housing has a distal end that is covered with an absorbent cotton sleeve that absorbs plating solution and holds the plating solution in contact with the anode during the plating process.

(4) An electrical conductor extends from the battery chamber and has an alligator clip fastened at its remote end. The clip may be fastened to an object that is being plated so that with the battery connected within the battery chamber, the clip attached to the object and the anode coated with plating solution engaging the object, an electrical circuit is completed through the object. An indicator light protrudes through the end wall of the housing and illuminates when the battery is functioning.

(5) A container cap is fastened to the anode just proximal of the proximal termination of the absorbent cotton sleeve. A seal is provided about the opening in the cap that surrounds the anode to provide an effective seal. A container filled with plating solution may be fastened to the cap with the distal end of the anode captured within the container so that the absorbent cotton material may absorb plating solution.

Accordingly, it is a first object of the present invention to provide a portable self-powered hand-held electroplating wand.

It is a further object of the present invention to provide such a wand with an elongated tubular housing coated with an insulative material such as rubber or is made from a non-conductive polymer.

It is a further object of the present invention to provide such a wand having a battery chamber designed to contain a small-sized DC battery such as a 9 volt battery.

It is a still further object of the present invention to provide such a wand with a container cap coupled to the anode thereof and wherein a container of plating solution may be coupled to the cap with the end of the anode captured within the container.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
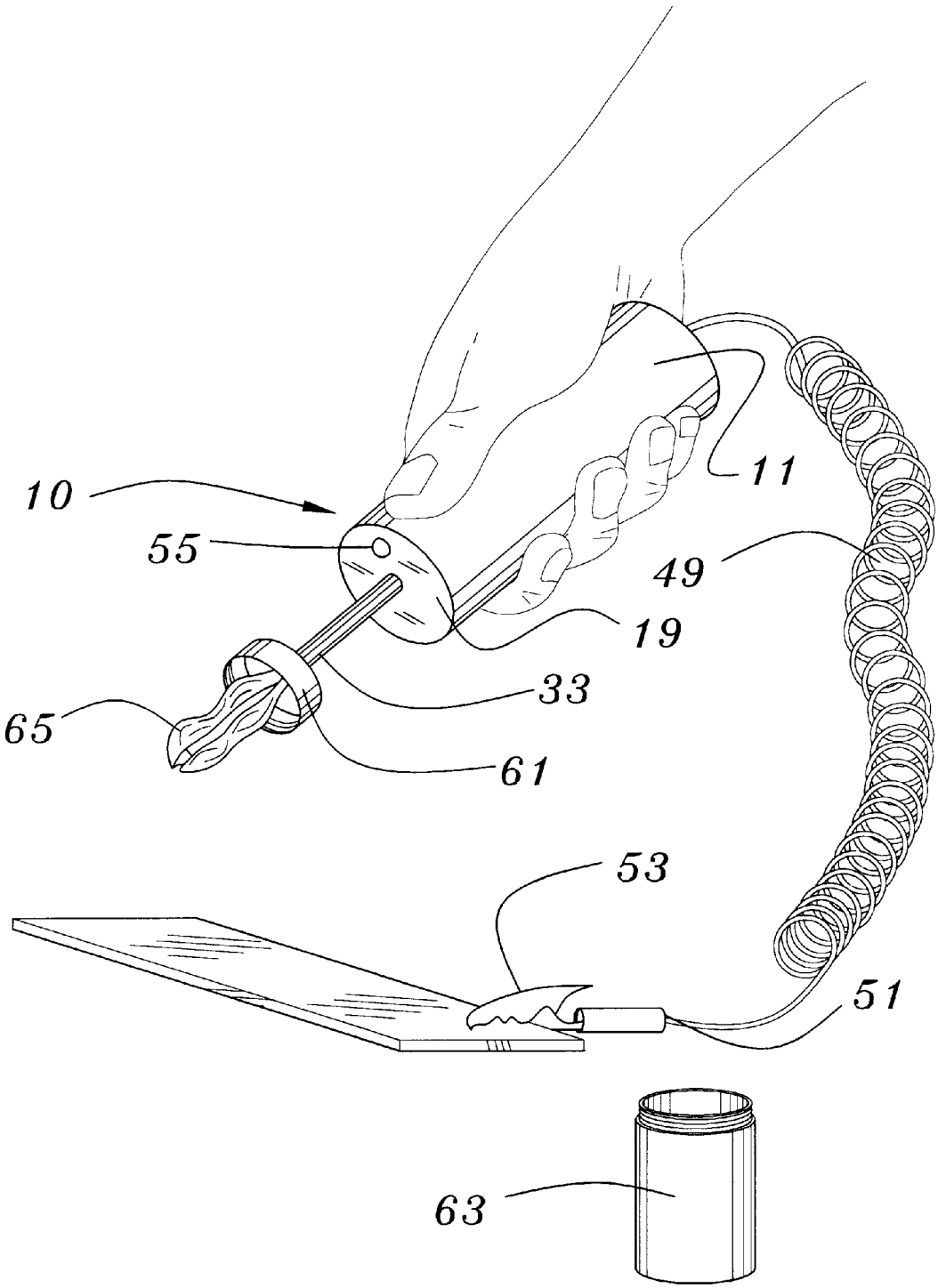
FIG. 1 shows a perspective view of the present invention.
Figure 2:
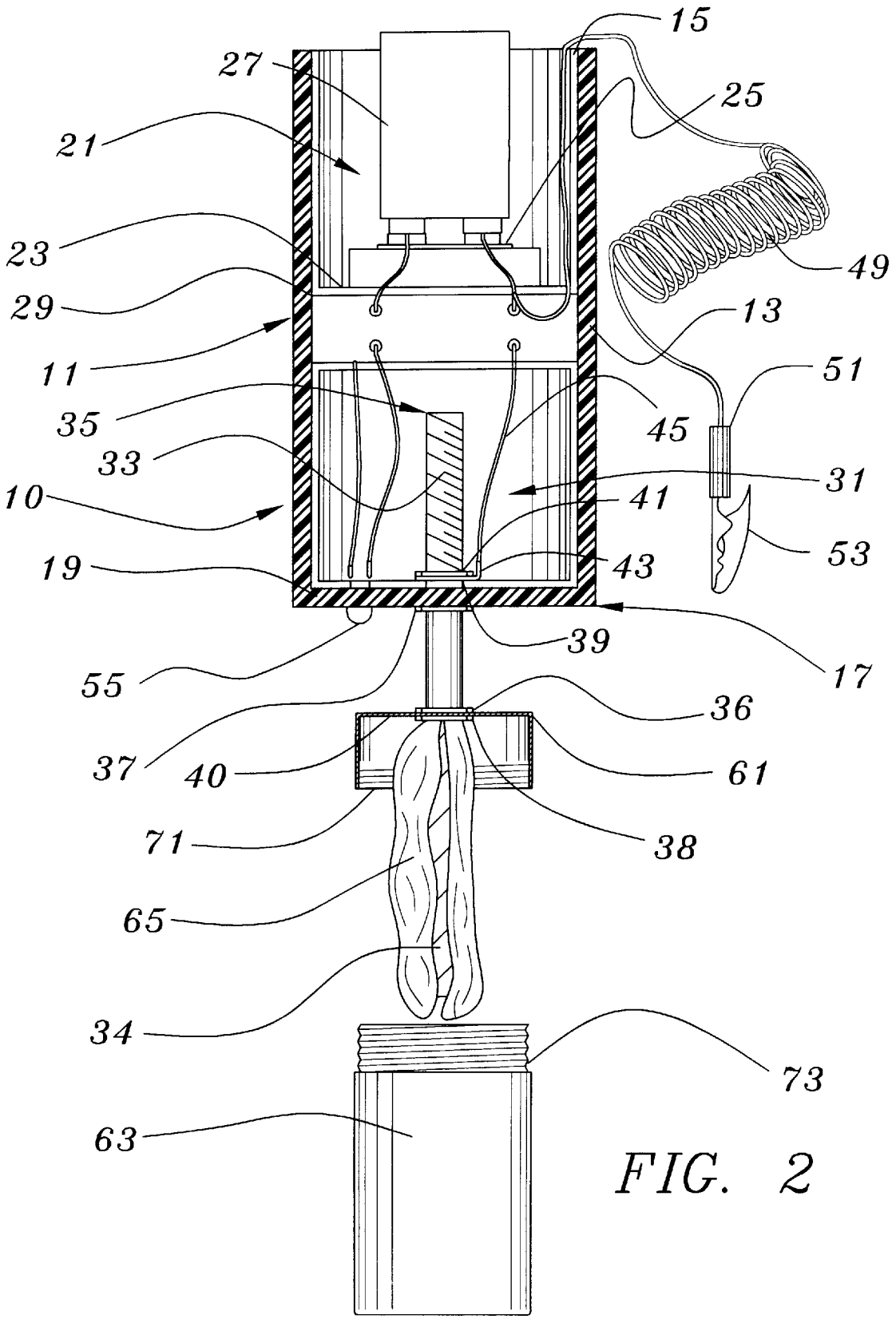
FIG. 2 shows a side view of the present invention, partially exploded and partially in section to show detail.

With reference to FIGS. 1 and 2, the present invention is generally designated by the reference numeral 10 and is seen to include an elongated tubular housing 11 having side walls 13 covered with an insulative material such as, for example, rubber or the housing is made from a non-conductive polymer. The housing 11 has a first open end 15 and a second end 17 defined by an end wall 19.

At the first end 15 of the housing 11, a battery chamber 21 is provided that has a forward end 23 provided with a battery terminal set 25 including positive and negative terminals designed to couple with a typical 9 volt DC battery 27. Batteries of different sizes can be employed with higher or lower voltage capacity. A partition wall 29 provides a solid surface on which the terminal set 25 is mounted.

The housing 11 also includes a forward chamber 31 in which is contained the proximal end 35 of an anode 33. As seen in FIG. 2, the proximal end 35 of the anode 33 is threaded and the anode 33 has a shoulder 37 that bears against the end wall 19 of the housing 11 and a nut 39 bearing against an inner side of the wall 19 clamps the anode 33 in the position shown. A second nut 41 clamps an electrical terminal 43 in electrical connection with the anode 33 and includes an electrical conductor 45 attached thereto that connects the terminal 43 with the positive side of the battery 27.

An electrical conductor 49 is connected to the negative side of the battery 27 and has a remote end 51 to which is coupled an alligator clip 53 of known design.

A battery indicator light 55 protrudes through the end wall 19 of the housing 11 and is connected in parallel with the battery to show battery power. A dim light indicates a need for a new battery.

With further reference to FIG. 2, it is seen that a cap 61 of a container 63 is coupled to the anode 33. As also seen in FIG. 2, the anode 33 has a distal end 34 and an absorbent cotton sleeve 65 is mounted is over the end 34 of the anode and extends proximally a significant distance. Other absorbent materials could be substituted for the cotton sleeve. The sleeve 65 terminates just distal of the coupling connection between the cap 61 and the anode 33. As seen in FIG. 2, the anode 33 has a shoulder 36 that forms a limit stop and also includes a sealing material designed to prevent leakage therepast.

Distal of the shoulder 36, the anode 33 is threaded and a nut 38 is threaded thereover and presses a seal 40 against the inner wall of the cap to more effectively seal against fluid leakage.

As also seen in FIG. 2, the inner walls of the cap 61 are threaded as designated by the reference numeral 71 and the container 63 includes an outer threaded portion 73 that enmeshes with the threads 71 of the cap to allow the container 63 to be affixed to the cap and, as should be understood from FIG. 2, to enclose the end 34 of the anode as well as the sleeve 65.

Figure 3:
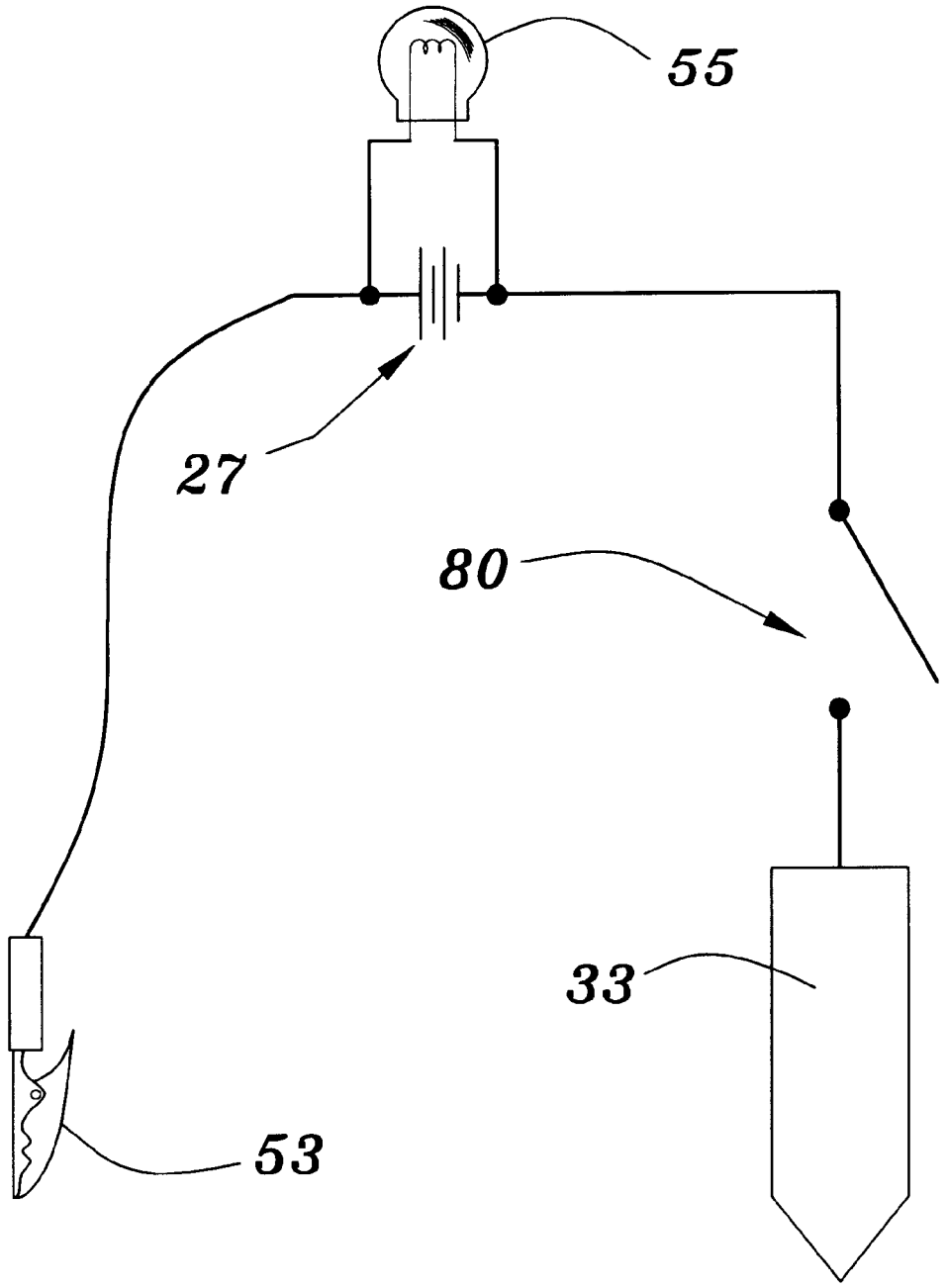
FIG. 3 shows a schematic representation of the electrical circuitry of the present invention.

FIG. 3 shows a schematic representation of the electrical circuitry of the present invention. FIG. 3 shows an optional on-off switch 80 that may be incorporated into the electrical circuitry, as desired. Normally, the system is operated by plugging in the battery 27. The system is shut down by removing the battery.

As should now be understood, when it is desired to electroplate a metallic object, the alligator clip 53 is fastened to the metallic object at a location near the location where the electroplating is to take place. Electroplating solution is filled within the container 63 and the end 34 of the anode 33 is dipped within the container 63 to coat the absorbent cotton sleeve 65 with the plating solution. When the end 34 of the anode 33 with its covering sleeve 65 is engaged to the object, an electrical connection is completed through the object and electroplating process proceeds. Generally, the plating solution will contain a precious metal such as platinum, gold or silver or a bath to remove chrome prior to plating with the precious metal. The preferred precious metal is gold. The device of this invention provides a means to ensure lifetime gold plating on a given surface already containing gold even if portions of the base gold have worn away. The electroplating wand of this invention permits an easy way of touching-up gold to a surface that has been partially rubbed clear of its original gold layer.

Accordingly, an invention has been disclosed in terms of a preferred embodiment thereof which fulfills each and every one of the objects of the present invention as set forth hereinabove and provides a new and useful portable self-powered hand-held electroplating wand of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A portable hand-held electroplating wand, comprising:

a) an elongated housing adapted to be held in the palm of a hand, the housing having a first end and a second end;

b) said first end of said housing defining a battery chamber adapted to receive a battery;

c) said second end of said housing terminating at an end wall through which an anode extends;

d) an absorbent sleeve covering an anode end portion extending outside the housing for dipping into a container containing a plating solution outside the elongated housing;

e) a container cap axially mounted on the anode end portion proximal to the housing;

f) a conductor extending from said housing;

g) said conductor connected to a metallic object and said anode adapted to apply the plating solution obtained from the container outside the elongated housing to said object.

2. The wand of claim 1, wherein said anode end portion has a plating solution absorbent cotton cloth as the absorbent sleeve covering material.

3. The wand of claim 1, wherein a container is removably attachable to said cap, said container enclosing said anode end portion when attached to said cap.

4. The wand of claim 3, wherein said cap and an opening of said container have enmeshing threads.

5. The wand of claim 1, wherein said anode end portion extends through an opening in said cap and said opening includes seal means sealing about said anode end portion.

6. The wand of claim 1, further including an indicator light that illuminates when the battery is functioning.

7. The wand of claim 6, wherein said light is mounted on said end wall and the battery produces a voltage of 9 volts.

8. The wand of claim 1, wherein said housing has a partition wall separating said battery chamber from said end wall.

9. The wand of claim 1, wherein said housing is tubular.

10. The wand of claim 9, wherein said housing has an outer surface covered with an electrically insulative material.

11. The wand of claim 10, wherein said material is rubber.

12. A portable hand-held electroplating wand, comprising:

a) an elongated tubular housing having a first end and a second end;

b) said first end of said housing defining a battery chamber adapted to receive a battery;

c) said second end of said housing terminating at an end wall on which an indicator light is mounted and through which an anode extends with a first portion of the anode inside the housing and a second portion outside the housing; and d) a conductor extending from said first end of said housing;

e) said second portion of the anode having a plating solution absorbent cloth material mounted over an end thereof and proximal of said anode end, a cap is axially mounted thereon;

f) said conductor connected to a metallic object and said anode adapted to apply a plating solution to said object obtained from a container removably attachable to the cap.

13. The wand of claim 12, wherein the container encloses said anode end when attached to said cap.

14. The wand of claim 13, wherein said cap and an opening of said container have enmeshing threads.

15. The wand of claim 14, wherein said anode extends through an opening in said cap and said opening includes seal means sealing about said anode.

16. The wand of claim 12, further wherein said indicator light illuminates when said battery is functioning.

17. The wand of claim 12, wherein said housing has an outer surface covered with an electrically insulative rubber material.

18. The wand of claim 12, wherein said cloth material comprises cotton.

19. The wand of claim 12, wherein said housing is made from a non-conductive polymer.

* * * * *